United States Patent [19]

Harbison et al.

[11] Patent Number: 4,726,742

[45] Date of Patent: Feb. 23, 1988

[54] GUIDE STRUCTURE FOR SUBMERSIBLE PUMP SYSTEM

[75] Inventors: Joe A. Harbison, Gladstone, Mo.; Nyle D. LaGrange, Lenexa, Kans.

[73] Assignee: The Marley-Wylain Company, Mission, Kans.

[21] Appl. No.: 873,781

[22] Filed: Jun. 12, 1986

[51] Int. Cl.[4] ..... F04B 17/00; F04B 35/00

[52] U.S. Cl. ..... 417/360; 417/361

[58] Field of Search ..... 417/360, 361; 415/126; 285/24, 27, 325; 166/85, 88, 68.5, 69; 222/180

[56] References Cited

U.S. PATENT DOCUMENTS

| | | | |
|---|---|---|---|
| 3,247,864 | 4/1966 | Conery | 137/394 |
| 3,427,982 | 2/1969 | Englesson | 417/360 |
| 3,592,564 | 7/1971 | Conery | 417/360 |
| 3,628,812 | 12/1971 | Larralde et al. | 285/24 |
| 3,635,606 | 1/1972 | Blum | 417/360 |
| 3,722,757 | 3/1973 | Dahlgren | 417/360 |
| 3,771,914 | 11/1973 | Crespo | 417/360 |
| 3,771,915 | 11/1973 | Back | 417/360 |
| 3,797,970 | 3/1974 | Blum | 417/360 |
| 3,851,898 | 12/1974 | Ihara | 285/24 |
| 3,861,834 | 1/1975 | Blum | 417/360 |
| 3,880,553 | 4/1975 | Wolford et al. | 417/360 |
| 3,885,714 | 5/1975 | Sjostrand | 417/360 |
| 4,019,213 | 4/1977 | Behar et al. | 137/236.1 |
| 4,043,707 | 8/1977 | Heumann et al. | 417/360 |
| 4,060,345 | 11/1977 | Blum | 417/360 |
| 4,324,531 | 4/1982 | Sarvanne | 417/360 |

*Primary Examiner*—Carlton R. Croyle

*Assistant Examiner*—Donald E. Stout

*Attorney, Agent, or Firm*—Schmidt, Johnson, Hovey & Williams

[57] ABSTRACT

Structure for guiding a submersible pump along an upright path of travel includes a wire-like connector coupled to the pump unit, and the connector is shaped to slidably engage two outwardly extending portions of an upright guide rail which is I-shaped in transverse configuration. The wire-like connector cleans debris from the rail during vertical movement of the pump and also enables the unit to be tilted as necessary. When the pump unit is shifted to approach a lowermost position for pumping fluids, a directing means comprising outwardly extending plates with inclined surfaces thereon engages horizontal arms connected to a pump outlet flange so that the pump is precisely guided both vertically and horizontally to a position wherein the pump outlet flange is in flat, parallel, face-to-face relationship with an inlet flange of a stationary discharge pipe. A curved peg which extends outwardly from the discharge pipe flange is received within a recess of the pump unit flange as the pump is lowered, and the peg functions to retain the pump flange in spaced disposition relative to piping inlet flange so that seizing of the two flanges is substantially precluded. The guide structure and directing means provide minimal contact areas between moving components so that entrapment of debris and particles, which would otherwise cause frictional resistance to free movement of the pump, is minimized, and the possibility of seizing is virtually eliminated.

12 Claims, 7 Drawing Figures

GUIDE STRUCTURE FOR SUBMERSIBLE PUMP SYSTEM

BACKGROUND OF THE INVENTION

1. Field of the Invention

This invention relates to structure for guiding a submersible pump along an upright axis toward and away from a lowermost position wherein the pump outlet is in adjacent, fluid-communicating relationship with an inlet of a stationary discharge pipe. The guide structure includes a stationary, upright, transversely I-shaped guide rail and a wire-like connector coupling the pump to the rail, and the connector is configured to clean the rail during movement of the pump to minimize binding. The invention also is directed to an alignment means for maintaining an outlet flange of the pump in spaced disposition from an inlet flange of the discharge pipe when the pump unit is in its lowermost position so that seizing of the two flanges is substantially precluded. A pair of outwardly extending, transversely D-shaped arms coupled to the pump flange engage inclined, marginal edge portions of two elements which flank the discharge pipe inlet flange.

2. Description of the Prior Art

A variety of means have been proposed in the past for lifting submersible pump units out of a pump basin, tank or the like so that the pump can be serviced or replaced when necessary. Oftentimes, guide structure is provided for directing movement of the pump unit along an upright axis toward and away from a lowermost position wherein an outlet flange of the pump unit is in adjacent, face-to-face fluid-communicating relationship with an inlet flange of a stationary discharge pipe that is commonly secured to the walls of the tank or basin. One principal function of such lifting means and guide structures is to reduce the likely necessity of employing a diver to descend into the liquid for manual connection of the pump to the discharge pipe.

In the past, certain submersible pump guide structures have comprised a relatively stiff, vertical guide rail that is fixed to a bottom of a tank or basin or other structure therein, and the guide structures further include a connector that is slidably received on the guide rail and coupled to a pump unit. One example of such guide structure is shown in U.S. Pat. No. 3,797,970 to Blum, and takes the form of an elongated, generally cylindrical connector that is slidably received around a cylindrical guide tube. Unfortunately, it has been found that the sliding interconnection between the cylindrical connector and the guide tube shown in U.S. Pat. No. 3,797,970 inherently provides a relatively large amount of slidably engaging surface areas that are subject to frictional forces which resist attempts to lift the pump from the basin. Additionally, if the lifting device or hoist is not in precise vertical alignment with the center of gravity of the pump unit, the cylindrical connector will bind as the pump is raised. Moreover, the annular gap between the connector and the guide tube shown in U.S. Pat. No. 3,797,970 creates a relatively large chamber for entrapment of particulates and debris that are normally present in sewage and other waste waters, and these particulates further cause binding between the connector and the guide tube to resist lifting of the pump. Any corrosion in the interior surfaces of the connector or the outer surfaces of the guide tube will also undesirably increase the amount of friction encountered during removal of the pump from the basin.

Other types of guide structures comprising upright, cylindrical guide tubes in combination with sliding, cylindrically surfaced connectors coupled to a pump unit are shown in U.S. Pat. Nos. 4,308,000 dated Dec. 29, 1981, 4,060,345 dated Nov. 29, 1977, and 3,771,915 dated Nov. 13, 1973. The guide structure shown in the last mentioned patent, U.S. Pat. No. 3,771,915 shows a pump unit secured to a carrier having two transverse bars formed to complementally engage a pair of spaced, upright guide tubes. Unfortunately, the use of two of such upright guide tubes can increase the amount of surface areas exposed to friction and further a dual guide tube arrangement is more subject to binding than a single guide tube apparatus when the hoist is not in proper, vertical alignment with the pump unit.

U.S. Pat. No. 3,771,914 dated Nov. 13, 1973 is directed to a guide structure having two spaced guide bars which are generally I-shaped in transverse configuration. However, the pump connector shown in U.S. Pat. No. 3,771,914 which slides along the upright guide bars resembles a collar or sleeve that is believed to provide an excessive amount of interengageable surface areas subject to frictional forces, in similar manner to cylindrical connectors.

It is also known that certain of the prior art guide structures enable the pump unit to be advantageously tilted during lifting of the same, in an attempt to avoid wedging effects between the slide connector and the guide tubes. An example of this type of device is shown in U.S. Pat. No. 4,324,531 dated Apr. 13, 1982 and comprises a bipartite slide having two upper and two lower projections which complementally slide along two spaced upright guide tubes, but each of these four projections contributes an undesirable amount of surface area for binding between the shiftable slide and the stationary guide tubes.

Those who are knowledgeable in the art will also readily recognize the fact that prolonged engagement of a flat face of an outlet flange with a flat face of a stationary discharge pipe will often corrode the flange faces and "seize" the flanges together. While corrosion can occur even with relatively clean liquids, this problem is highly aggravated in various waste water environments. Thus, in some instances, it has been found desirable to maintain the flanges in slightly spaced relationship, and utilize a flexible seal which is hydraulically forced into sealing engagement with the adjacent flange when the pump is in service. An example of a hydraulic seal is shown in U.S. Pat. No. 3,592,564, dated July 13, 1971 and assigned to the assignee of the present invention.

The aforementioned U.S. Pat. No. 4,308,000 has guide structure which includes a means for shifting the pump unit laterally as it approaches its lowermost position in an effort to move an outlet flange of the pump toward a position of adjacent, spaced relationship with an inlet flange of a stationary discharge pipe. The guide structure disclosed in U.S. Pat. No. 4,308,000 includes a spaced pair of vertical guide tubes that are slidably engageable with complemental, semicylindrical flanges connected to the rear of the pump, whereas the pump outlet flange extends outwardly from the front of the pump. As the pump unit of this reference descends to its lowermost position, the sliding connector flanges engage an inclined, upper cammed face of collars that are secured to the guide tubes in order to attempt lateral shifting of the pump unit toward a position wherein the pump flange is adjacent the outlet pipe flange.

However, it is believed that the guide apparatus shown in U.S. Pat. No. 4,308,000 is somewhat deficient in assuring that the pump flange is in proper spaced disposition from the discharge pipe flange when the pump unit is in its lowermost position. For one thing, the collars having camming surfaces are adjustably coupled to the guide tubes which are, in turn, spaced in remote relationship to the two flanges so that the spacing between the flanges is difficult to repeatedly attain with a reasonable degree of precision, a problem that can easily remain unnoticed in the submerged environment of waste water pumps. Secondly, any accidental deflection of the guide tubes, as perhaps would be caused during raising or lowering of the pump, will adversely affect the position of the flanges and the spacing therebetween. Finally, no means is provided in U.S. Pat. No. 4,308,000 for positively retaining the two flanges in spaced disposition, except as would otherwise inherently occur when the rear surface of the semicircular connector flanges engages a rear portion of the guide tubes, an occurrence that is unlikely to occur if the semicircular surfaces of the flanges are of a diameter large enough to enable a free, loose sliding fit as the pump unit is raised or lowered.

As can be appreciated from the foregoing, it would be a desirable advance in the field of submersible pump technology if a guide structure was provided for raising and lowering pumps from basins, tanks or the like with a minimum of friction and binding between engaging parts. Additionally, it would be desirable to provide a means for positively maintaining a pump outlet flange a predetermined horizontal spacing from a discharge pipe flange and, at the same time, provide horizontal alignment between the flanges so that discharge of fluids by the pump is not hindered by misaligned flanges. Such a guide structure would preferably allow tilting of the pump during raising or lowering thereof, but would also bias the pump back toward a position relative to horizontal so that the pump flange is in flat, parallel, face-to-face relationship with the discharge pipe flange when the pump unit reaches its lowermost position for subsequent pumping of fluids.

SUMMARY OF THE INVENTION

Our present invention overcomes the above noted disadvantages of conventional pump systems by provision of a guide structure that includes an elongated, upright guide rail and a wire-like connector that slidably engages the guide rail along two single lines of contact. The connector is a generally cylindrical wire formed to a shape comprising two horizontally opposed U-shaped portions which are each received around horizontally extending wall portions of an upright, I-shaped guide rail. Consequently, the use of a wire-like connector in combination with the flat surfaces of an upright guide rail enables the curved surfaces of the connector to clean the rail during movement therealong without entrapment of particulate matter. Such structure is particularly advantageous over collars or sleeves that are received around upright guide tubes and which thereby tend to entrap debris while, at the same time, present large surfaces which frictionally oppose movement of the sleeve along the guide tube.

Advantageously, the wire-like connector is formed to a configuration to enable the pump to be tilted during raising thereof, which tilting further decreases the contact of the connector with the guide rail to minimize friction. Moreover, the connector is preferably shaped to include two upstanding portions engageable with a rear surface of the guide rail wall portions so that the pump is retained in a horizontal orientation during lowering of the pump to ensure proper, parallel alignment of the pump outlet flange with the discharge pipe flange as the pump shifts towards its lowermost position.

In certain forms of the invention, the discharge pipe outlet flange is provided with an outwardly extending body or peg that is slidably received in a recess formed in a clamp ring coupled to the pump outlet flange. The peg is received in the recess when the pump approaches its lowermost position, and the peg has an end surface configured to maintain the pump flange a predetermined distance from the discharge pipe flange. The peg also has a curved upper surface that contacts a downwardly facing, concave upper surface of the recess so that the two flanges are horizontally aligned by means of a single line of contact that is present between the curved, convex surface of the peg and the concave surface of the clamp ring defining the recess. Consequently, the peg is operable to maintain the pump outlet flange a predetermined, spaced distance from the discharge pipe flange and in horizontal alignment thereto regardless of factors affecting the configuration of the guide rail and/or the guide rail connector, in contrast to the structure shown in U.S. Pat. No. 4,308,000.

In other forms of the invention, a pair of arms extend outwardly from the top of the pump outlet flange for engagement with one of two elements or plates which flank the discharge pipe flange. The plates have an upwardly facing, inclined surface which normally engages flattened surfaces of the arms; however, the arms also have curved surfaces adjacent the flattened surfaces which are operable to readily rock the pump unit back toward its normally horizontal disposition in instances where the pump unit is tilted. The pair of arms, in combination with the outwardly extending peg, provide a three point contact between the pump unit and the discharge pipe when the pump reaches its lowermost position, so that seizing of the materials is substantially precluded without sacrifice of proper alignment between the two flanges.

DETAILED DESCRIPTION OF THE DRAWINGS

Figure 1:
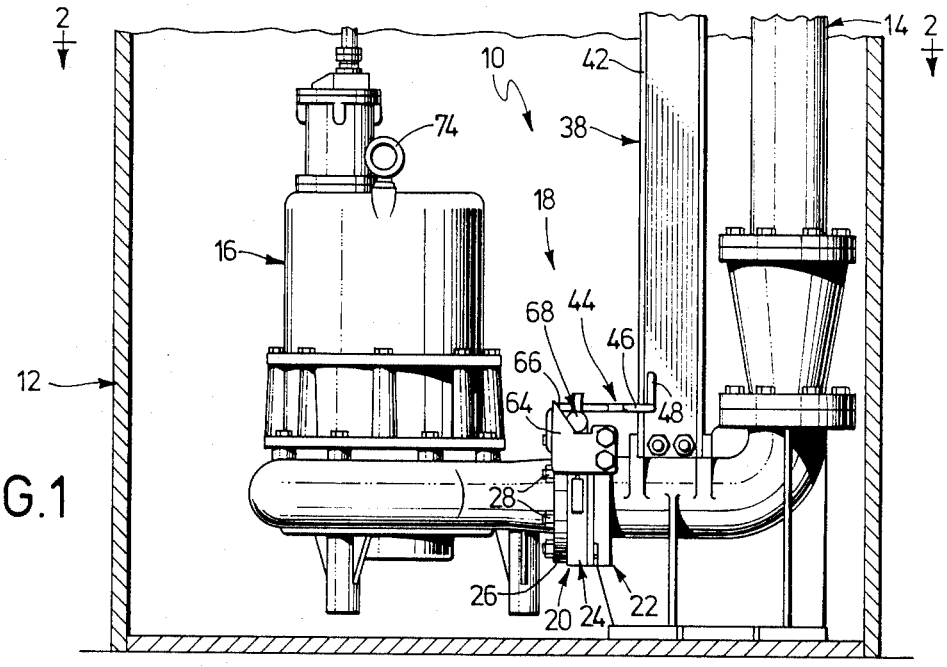
FIG. 1 is a side elevational view of a shiftable pump unit and a stationary discharge pipe along with the guide structure of the present invention, wherein the pump and discharge pipe are disposed in a cylindrical basin that is shown in cross-section.
Figure 2:
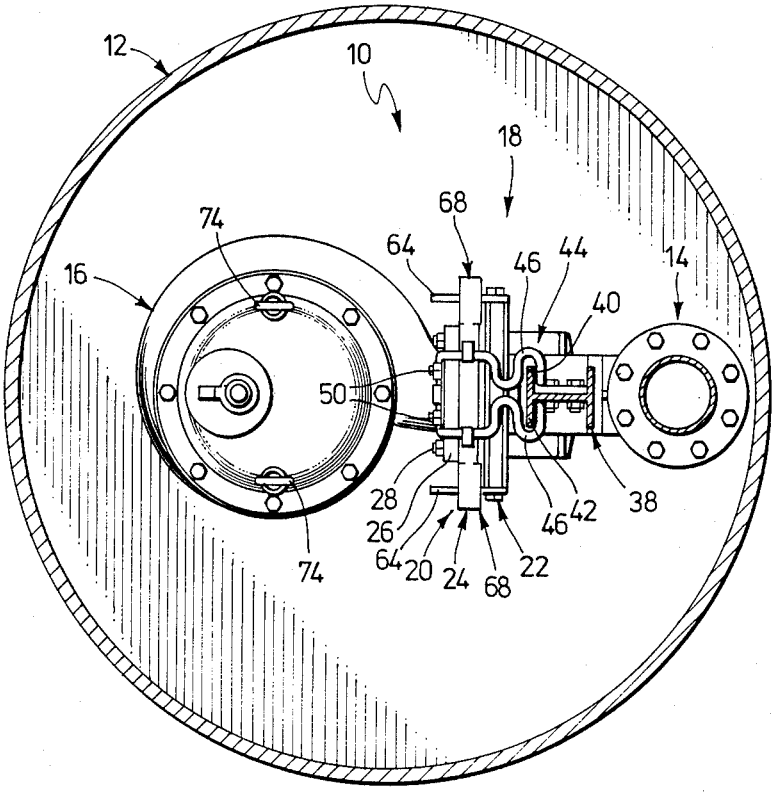
FIG. 2 is a view taken along line 2—2 of FIG. 1.

Referring initially to FIGS. 1 and 2, a submersible pump system 10 is disposed within a tank or basin 12 and includes normally stationary discharge piping, broadly designated 14, and a pump unit 16 for pumping fluids through the discharge piping 14 for ejectment from the basin 12 as may be required for further processing, treatment or disposal. The pump unit 16 particularly illustrated is useful in municipal lift stations or in large storm drainage systems, and might be rated at 40 horsepower for maximum flows of 1,200 gallons per minute, while presenting a weight of 900 pounds or more, although it should be understood in this respect that the size of the pump system 10 shown in FIGS. 1–7 is for exemplary purposes only.

A guide structure 18 directs selective movement of the pump unit 16 along an upright axis toward and away from a lowermost position wherein an outlet flange means or flange 20 of the pump unit 16 is in adjacent, face-to-face parallel relationship with an inlet flange 22 coupled to the stationary discharge piping 14. When the pump unit 16 is in its lowermost position, a fluid outlet of the pump unit 16 that is surrounded by the outlet flange 20 is in adjacent, fluid-communicating relationship with an inlet of the piping 14 which is surrounded by flange 22.

The pump outlet flange 20 is shown in more detail in FIGS. 3–6 and includes a connector flange 24 that is releasably secured to a pump casing flange 26 by a plurality of bolts 28. The connector flange 24 includes a ring member 30 having an annular passageway 32 therein (see FIG. 5) and a resilient diaphragm or seal 34 that is releasably fixed to the ring member 30 by a clamp ring 36. When the pump unit 16 is in its lowermost position, hydraulic pressure exerted on fluid within passageway 32 flexes the seal 34 outwardly to the position shown in FIG. 5 for engagement with an end surface of the piping inlet flange 22, in similar arrangement to the structure shown in the aforementioned U.S. Pat. No. 3,592,564.

The guide structure 18, in more detail, comprises an elongated, rigid guide member or rail 38 that has a generally I-shaped configuration in horizontal transverse section, as illustrated in FIGS. 1–4. The rail 38 thus presents first and second upright, elongated wall edge portions 40, 42 (FIG. 2) which extend outwardly in horizontal directions in generally opposite relation from each other. The wall edge portions 40, 42 lie in a common plane that is transverse to the direction of fluid discharge through pump outlet flanges 20, as well as transverse to a reference plane extending through the upright axis of travel of the pump unit 16 and the longitudinal axis of the guide member or rail 38. Additionally, the rail 38 is immovably secured at its lower end to a wall of the discharge piping 14, and is supported at its upper end by suitable framework (not shown).

A connector 44, as depicted in FIGS. 1–4 and 6, couples the pump unit 16 to the guide rail 38 for movement in either direction along the longitudinal axis of the latter. The connector 44 preferably comprises an elongated, wire-like, single rod formed to present two rod sections each having an L-shaped configuration in elevational view and including oppositely oriented U-shaped portions 46, 46 that normally lie in a horizontal plane. The U-shaped portions 46, 46 as shown in FIG. 2, are each configured to extend partially around one of the wall edge portions 40, 42 for slidable sliding engagement with the same. Although the connector 44 is shown as a single formed rod, the connector 44 could alternatively be comprised of two separate rod segments.

The connector rod 44 is preferably circular in planes transverse to the longitudinal axis of the connector 44 to thereby present curved segments for cleaning debris from the wall edge portions 40, 42 as the connector 44 travels along the guide rail 38. The curved segments of the connector 44 substantially reduce the likelihood of entrapment of debris between the connector and the guide rail 38, and instead tend to deflect the debris of particles toward a position away from the connector 44. Additionally, the circular transverse configuration of the connector 44 thereby presents a single line of contact with each of the wall edge portions 40, 42 to minimize the frictional resistance to movement of the pump unit 16 toward and away from its lowermost position.

Figure 3:
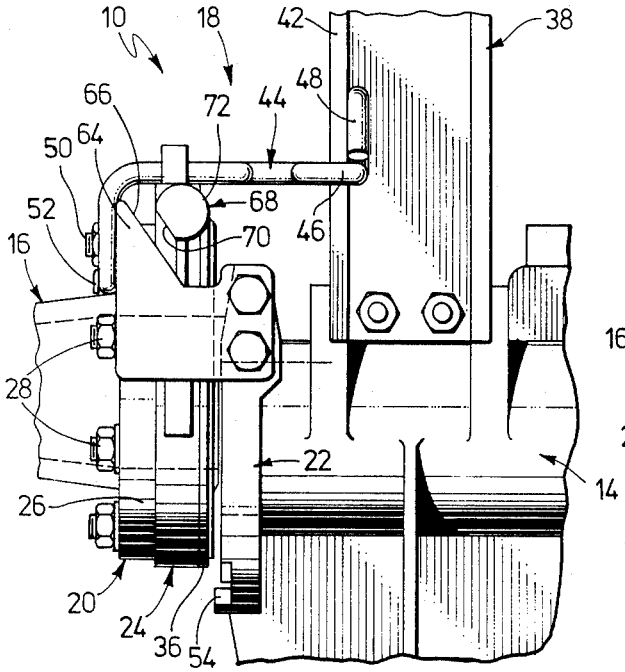
FIG. 3 is a fragmentary, enlarged, side elevational view of the guide structure shown in FIG. 1, illustrating an instance wherein the pump unit is approaching a lowermost position but has not yet reached the same.
Figure 4:
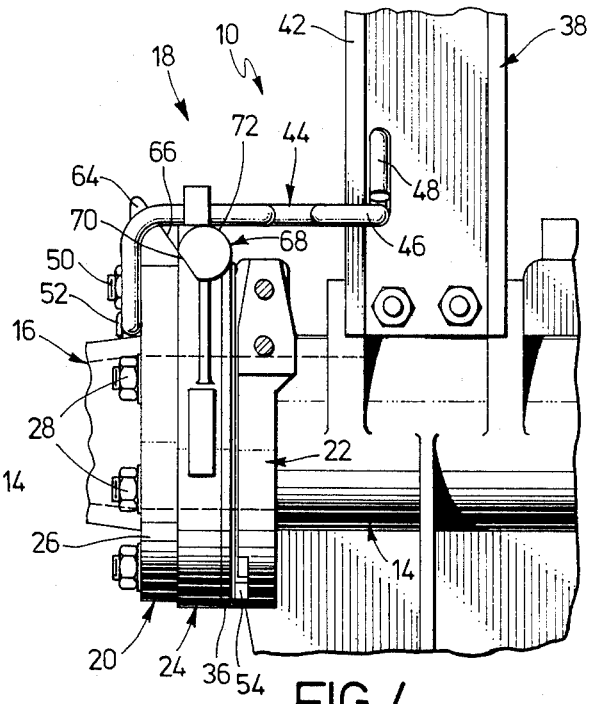
FIG. 4 is a view somewhat similar to FIG. 3 but where the pump unit has reached its lowermost position and an alignment means functions to maintain a pump outlet flange in spaced disposition from a discharge pipe flange, with one of the elements or plates of the alignment means removed for clarity.

Referring to FIGS. 1, 3–4 and 6, the connector 44 advantageously is formed to present two looped portions 48, 48 which extend upwardly from the U-shaped portions 46, 46 orthogonally in a normally vertical plane and which are rigidly connected to a respective one of the same. The portions 48, 48 are engageable with the rear surface of wall edge portions 40, 42 for maintaining the pump unit 16 in a predetermined orientation relative to horizontal as the pump unit 16 is shifted toward its lowermost position. On the other hand, during raising of the pump unit 16, the configuration of the U-shaped portions 46, 46 enables the pump unit 16 to be tilted to an angular disposition relative to horizontal, and the upwardly extending portions 48, 48 shift away from the rear surfaces of wall edge portions 40, 42 to further minimize frictional resistance to upward movement of pump unit 16. As shown in FIGS. 3–4, the connector 44 is secured to the casing flange 26 by two bolts 50 as well as a hook 52.

Figure 5:
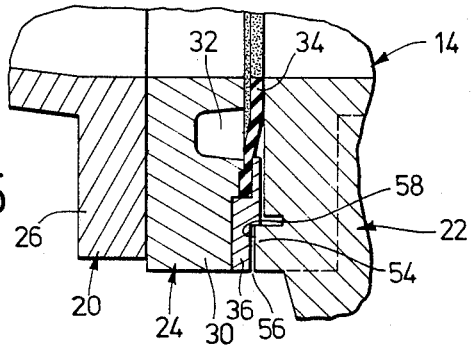
FIG. 5 is a fragmentary, enlarged, sectional view of the flanges shown in FIG. 4, particularly illustrating a connector flange disposed between the pump outlet flange and the discharge pipe inlet flange which carries a resilient seal that engages the discharge pipe flange as the pump is actuated for pumping fluids.
Figure 6:
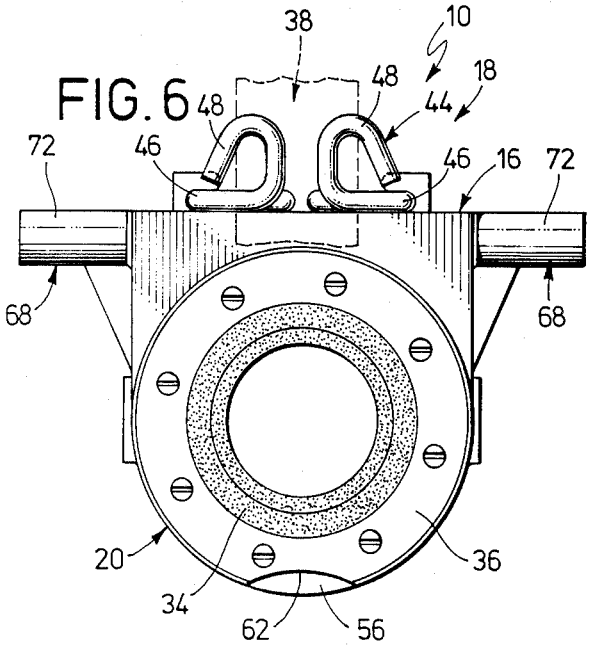
FIG. 6 is an enlarged, end elevational view of the pump unit and guide rail connector shown in FIG. 3, with the disposition of a portion of the rail being shown in dashed lines.
Figure 7:
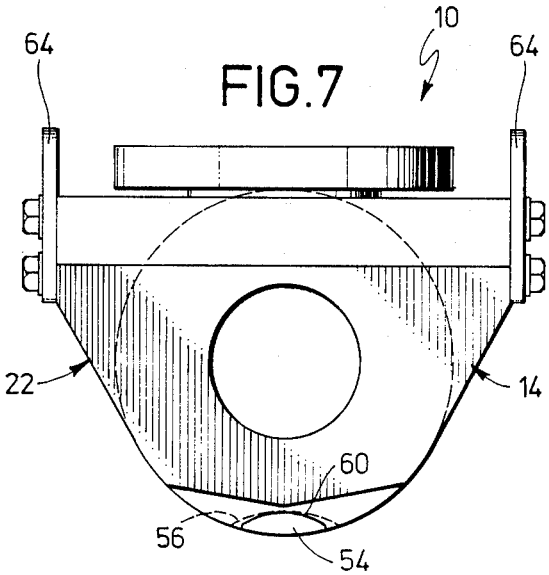
FIG. 7 is an enlarged, end elevational view, taken in opposite direction from the illustration of FIG. 6, depicting the discharge pipe inlet flange and a peg of the alignment means, and wherein the position of the pump outlet flange when the pump is in its lowermost position is shown in dashed lines.

An alignment means is operable to maintain the pump outlet flange 20, and particularly the clamp ring 36 therein, in spaced, non-engaging relationship to the outermost end face of the piping inlet flange 22 when the pump unit 16 is in its lowermost position, so that seizing of the clamp ring 36 to the piping inlet flange 22 is substantially precluded. The alignment means includes an outwardly extending body or peg 54 (in this regard, see FIGS. 3–5 and 7) that is integrally formed with the piping inlet flange 22. The alignment means also includes a recess 56 which is defined by structure of the clamp ring 36, as is best viewed in FIG. 6. The peg 54 is of such a length in an outward direction from the flange 22, and the recess 56 is of such a depth to cooperably, substantially prevent the clamp ring 36 from engaging with the piping inlet flange 22. During lowering of pump unit 16, the body or peg 54 move toward the recess in a direction parallel to the direction of fluid discharge through the pump outlet flange 20. As shown in FIG. 5, a flat end surface 58 of the peg 54 contacts the structure defining the recess 56 when the pump unit 16 is in its lowermost position.

Preferably, the peg 54 has an upper curved or convex surface 60 (FIG. 7) that is engageable with a downwardly facing, concave surface 62 (FIG. 6) of the structure defining the recess 56. The surfaces 60, 62 provide a means for maintaining horizontal alignment between the pump outlet flange 20 and the piping inlet flange 22 when the pump unit 16 is in its lowermost position. As shown, the concave surface 62 of the structure defining the recess 56 has a greater radius of curvature than the radius of curvature of the convex surface 60 of peg 54, so that only a single line of contact is present between the surfaces 60, 62 when the pump unit 16 is shifted to its lowermost position, as is perhaps best evidenced by reference to FIG. 7.

The guide structure 18 is operable to guide movement of the pump unit 16 along an upright axis within in the basin 12. However, when the pump unit 16 is closely adjacent its lowermost position, a directing means is operable to guide movement of the pump unit 16 in both horizontal as well as vertical directions toward and away from the lowermost position of the pump unit 16 wherein the pump outlet flange 20 is in parallel, face-to-face, fluid-communicating relationship with the piping inlet flange 22.

More particularly, the directing means comprises a pair of elements or plates 64, 64 which are bolted to the piping inlet flange 22, as shown in FIGS. 1–4 and 7. The plates 64, 64 each present an inclined, flat marginal edge portion 66 that faces an upward direction. The directing means also includes two elongated arms 68, 68 that extend horizontally outwardly in opposite directions from an upper portion of the connector flange 24.

Viewing FIGS. 3 and 4, each of the arms 68, 68 has a D-shaped configuration in a cross-section transverse to the longitudinal axis thereof to present a flat portion 70 and a curved portion 72 that is adjacently connected to both sides of the flat portion 70. During normal downward movement of the pump unit 16, the flat portions of arms 68 approach the marginal edge portion 66 of the plates 64 in parallel relationship thereto, as shown in FIG. 3, and continued downward movement of the pump unit 16 thereafter brings the flat portions 70 into flat engagement with marginal edge portions 66, as seen in FIG. 4. The flat portions 70, in cooperation with the marginal edge portions 66, retain the pump unit 16 in a generally horizontal orientation during engagement of arms 68 with the plates 64.

During engagement of the arms 68 with plates 64, the curved portions 72 are operable to enable rocking of the pump unit 16 from a tilted orientation back to a orientation that is generally horizontal and which is best viewed in FIG. 1. Such tilting of the pump unit 16 may occur, for example, during lowering of the pump unit 16 by means of a rope or chain (not shown) that is secured to eyelets 74 at the top of pump unit 16 (see FIGS. 1 and 2). During final stages of movement of pump unit 16 toward its lowermost position, the curved portions 72 will engage the marginal edge portions 66 if the pump unit 16 is tilted from horizontal, and the curved portions 72 will thereafter enable the pump unit 16 to be returned to a horizontal orientation as soon as tension on the rope or chain is decreased.

Turning now to FIGS. 4–7, it can be appreciated that the pump unit 16 in its lowermost position makes only a three point contact for support with stationary structure. Specifically, peg 54 engages the structure of clamp ring 36 defining the recess 56, and the flat portions 70 of each of the arms 68 contact the marginal edge portions 66 of plates 64. At the same time, peg 54 counteracts rotational forces generated during operation of pump unit 16 to thereby prevent the latter from "spinning" around the piping flange 22. Also noteworthy is the fact that when pump unit 16 is in its lowermost position, the U-shaped portions 46 of connector 44 are approximately centered around wall portions 40, 42 (FIG. 2) so that the connector 44 is in non-engaging relationship to the rail 38.

Minimum contact between elements of the pump unit 16, guide structure 18 and discharge piping 14 when the pump unit 16 is in its lowermost position for pumping fluid ensures that seizing due to corrosion of materials is substantially precluded. However, peg 54 provides both vertical and horizontal alignment of the pump outlet flange 20 to the piping inlet flange 22, while arms 68 in engagement with plates 64 retain the disposition of the upper portions of the pump outlet flange 20 in proper spacial relationship to the piping inlet flange 22 so that the connector flange 24 is in parallel, face-to-face relationship with the piping inlet flange 22. The dashed lines in FIGS. 3 and 4 indicate the orientation of the fluid conduits within the pump unit 16 and the discharge piping 14, and it can be seen in FIG. 4 that the fluid conduits are in horizontal alignment with each other when the pump unit 16 is in its lowermost position.

We claim:

1. In combination with a submersible pump system having normally stationary discharge piping presenting a fluid inlet, and a pump unit having a fluid outlet for discharge of fluid in a certain direction, guide structure for direction selective movement of said pump unit along an upright axis toward and away from a lowermost position wherein said outlet of said pump unit is in adjacent, fluid communicating relationship with said piping inlet for pumping of fluid, said guide structure comprising:

an elongated, upright guide member having a first wall edge portion and a second wall edge portion extending outwardly in horizontal directions in generally opposite relation from each other, said first and second wall portions being substantially flat and lying in planes that are generally transverse to said certain direction of fluid discharge, said guide member being rigid and fixedly connected to said stationary discharge piping for immobility relative thereto; and a connector coupling said pump unit to said guide member for movement along the latter, said connector comprising an elongated, wire-like rod means formed to present two rod sections each having an L-shaped configuration in elevational view with a generally horizontally extending portion and an upright portion rigidly connected to said generally horizontally extending portion, said generally horizontally extending portion of each rod section being U-shaped and extending partially around one of said wall portions and being slidably engageable with the same, said horizontally extending portions being generally circular in transverse cross-section with curved segments in vertical sectional planes engageable with said wall portions for cleaning debris from said guide member as said rod means travels along said guide member, whereby binding between said generally horizontally extending portions and said guide member is substantially precluded, said upright portions being slidably engageable with said first wall portion and said second wall portions as said pump is lowered toward said lowermost position for maintaining said pump unit in generally horizontal disposition, said pump unit being tiltable about said U-shaped portions in a direction about a generally horizontal axis as said pump unit is raised in order to shift said upright portions away from said first wall portion and said second wall portion and to generally avoid binding of said upright portions with said wall portions, each of said rod sections presenting only a single line of contact with the respective wall portions during raising of the pump unit away from its lowermost position.

2. The invention of claim 1, wherein said rod means comprises a single rod.

3. The invention of claim 1, wherein said guide member has a generally I-shaped configuration in longitudinally transverse directions.

4. In a submersible pump system having normally stationary discharge piping presenting a fluid inlet, and a pump unit having a fluid outlet for discharge of fluid in certain direction, guide structure for directing selective movement of said pump unit along an upright axis toward and away from a lowermost position wherein said outlet of said pump unit is in adjacent, fluid communicating relationship with said piping inlet for pumping of fluid, said guide structure comprising:

an elongated, upright guide member having an upright wall portion lying in a plane generally transverse to said certain direction of fluid discharge;

a connector coupling said pump unit to said guide member for movement along the latter, said connector including an elongated, wire-like rod section having a U-shaped portion configured to extend partially around said wall portion and being slidably engageable with the same during movement of the pump unit along said upright axis, said U-shaped portion of said rod section presenting only a single line of contact with said wall portion during movement of the pump unit along said upright axis; and alignment means for maintaining said connector including said U-shaped portion of said rod section in spaced, non-engaging relation to said guide member when said pump unit reaches said lowermost position for minimizing seizing of said connector with said guide member.

5. The invention of claim 4, wherein said rod means has upwardly extending portions slidably engageable with said first and second wall portions for maintaining said pump unit in a predetermined orientation relative to horizontal as said pump unit is shifted toward said lowermost position.

6. The invention of claim 4, wherein said rod means is generally circular in transverse cross-section, thereby presenting a line of contact with said wall portions.

7. In a submersible pump system having normally stationary discharge piping with flange means surrounding a fluid inlet, a pump unit with flange means surrounding a fluid outlet, said pump unit being selectively operable to discharge, fluid along a certain direction through said outlet, a normally stationary guide member and a connector shiftably coupling said pump unit to said guide member for selective movement of said pump unit along an upright axis toward and away from a lowermost position wherein said pump unit outlet is in adjacent, fluid-communicating relationship to said piping inlet, alignment means for maintaining said pump unit flange means in a fixed, predetermined position relative to said piping flange means when said pump unit is in said lowermost position, said alignment means comprising:

a body coupled to one of said pump unit and said discharge piping and extending outwardly in a direction toward the other of said pump unit and said discharge piping in generally parallel relationship to said certain direction; and structure defining a recess coupled to the other of said pump unit and said discharge piping, said body being formed for generally complemental, sliding insertion into said recess in a direction toward said other of said pump unit and said discharge piping and generally parallel to said certain direction as said pump unit is moved toward said lowermost position, said body presenting an end surface engageable with said structure defining said recess when said pump unit is in said lowermost position, said body and said recess being configured to retain said piping inlet flange means in substantially parallel, face-to-face relation to said pump outlet flange means when said pump unit is in said lowermost position, said body being of a length and said recess being of a depth that said end surface and said structure defining said recess retain said pump unit flange means in substantially spaced, non-engaging relation to said piping flange means when said pump unit is in said lowermost position whereby seizing of said pump unit flange means with said piping flange means is substantially precluded.

8. The invention of claim 7, wherein said body is connected to said piping flange means and said recess defining structure is coupled to said pump unit.

9. The invention of claim 8, wherein said body has an upper curved surface for engagement with said recess defining structure.

10. In a submersible pump system having normally stationary discharge piping with flange means surrounding a fluid inlet, a pump unit with flange means surrounding a fluid outlet, a normally stationary guide member and a connector shiftably coupling said pump unit to said guide member for selective movement of said pump unit along an upright axis toward and away from a lowermost position wherein said pump unit outlet is in adjacent, fluid-communicating relationship to said piping inlet, alignment means for maintaining said pump unit flange means in a fixed, predetermined position relative to said piping flange means when said pump unit is in said lowermost position, said alignment means comprising:

an outwardly extending body connected to said piping flange means; and structure defining a recess coupled to said pump unit, said body being formed for generally complemental, sliding insertion into said recess as said pump unit is moved toward said lowermost position, said body and said recess being configured to retain said piping inlet flange means in substantially parallel, face-to-face relation to said pump outlet flange means when said pump unit is in said lowermost position, said body being of a length and said recess being of a depth to complementally retain said pump unit flange means in substantially spaced, non-engaging relation to said piping flange means when said pump unit is in said lowermost position whereby seizing of said pump unit flange means with said piping flange means is substantially precluded, said body having an upper curved surface for engagement with said recess defining surface, said recess defining structure having a curved surface for engagement with said curved surface of said body, said surface of said recess defining structure having a greater radius of curvature than the radius of curvature of said curved surface of said body.

11. In a submersible pump system having normally stationary discharge piping with flange means surrounding a fluid inlet, a pump unit with flange means surrounding a fluid outlet, a normally stationary guide member and a connector shiftably coupling said pump unit to said guide member for selective movement of said pump unit along an upright axis toward and away from a lowermost position wherein said pump unit outlet is in adjacent, fluid-communicating relationship to said piping inlet, alignment means for maintaining said pump unit flange means in a fixed, predetermined position relative to said piping flange means when said pump unit is in said lowermost position, said alignment means comprising:

a body coupled to one of said piping flange means and said pump unit flange means and extending outwardly therefrom, said body having an end surface engageable with a surface on the other of said piping flange means and said pump unit flange means, said body being of such a length that said end surface is operable to maintain said pump unit flange means in spaced disposition from said piping flange means when said pump unit is in said lowermost position, said body having an upper surface adjacent said end surface and engageable with a portion of said other of said piping flange means and said pump unit flange means, said body upper surface being configured to maintain said pump unit flange means in horizontal alignment with said piping flange means when said pump unit is in said lowermost position.

12. In a submersible pump system having a normally stationary discharge piping having a fluid inlet, a pump unit having a fluid outlet, and guide structure for selective movement of said pump unit in either direction along an upright axis, means for directing said pump unit toward and away from a lowermost position wherein said pump unit outlet is in adjacent, fluid communicating relationship to said piping inlet for pumping fluid, said directing means comprising:

a first element presenting an inclined, marginal edge portion and connected to one of said pump unit and said discharge piping; and a first arm extending outwardly from the other of said pump unit and said discharge piping and being slidably engageable with said inclined marginal edge portion of said element;

said first arm having a generally flat portion normally engageable with said inclined portion of said first element in parallel relationship thereto when said pump unit is in a first predetermined orientation to horizontal during movement of said pump unit toward said lowermost position, said arm having curved portions adjacently connected to said flat portions for engagement with said inclined portion of said element when said pump unit is in a second orientation relative to a horizontal during movement of said pump unit toward said lowermost position, said curved portions during engagement with said inclined portion of said first element enabling rocking of said pump unit from said second orientation to said first predetermined orientation so that said pump unit is in adjacent, fluid communicating relationship to said discharge piping inlet when said pump unit reaches said lowermost position.

* * * * *